US007601244B2

(12) United States Patent
Iijima et al.

(10) Patent No.: US 7,601,244 B2
(45) Date of Patent: Oct. 13, 2009

(54) PRESS FOR PAPER MACHINE WITH SMOOTHING PRESS, AND PAPER PRODUCTION METHOD

(75) Inventors: Hidemasa Iijima, Hiroshima (JP); Takasi Bando, Hiroshima (JP); Hirosi Iwata, Hiroshima (JP); Daisuke Goto, Hiroshima (JP); Kotaro Shinoda, Tokyo (JP)

(73) Assignee: Oji Paper Co., Ltd., Tokyo (JP)

( * ) Notice: Subject to any disclaimer, the term of this patent is extended or adjusted under 35 U.S.C. 154(b) by 398 days.

(21) Appl. No.: 10/555,773

(22) PCT Filed: May 12, 2004

(86) PCT No.: PCT/JP2004/006686

§ 371 (c)(1),
(2), (4) Date: Aug. 11, 2006

(87) PCT Pub. No.: WO2004/101885

PCT Pub. Date: Nov. 25, 2004

(65) Prior Publication Data

US 2007/0023155 A1 Feb. 1, 2007

(30) Foreign Application Priority Data

May 13, 2003 (JP) ..... 2003-134264

(51) Int. Cl.
*D21F 3/04* (2006.01)

(52) U.S. Cl. ..... 162/360.2; 162/205; 162/361

(58) Field of Classification Search ..... 162/205, 162/206, 358.1, 358.3, 358.5, 359.1, 360.2, 162/360.3, 361
See application file for complete search history.

(56) References Cited

U.S. PATENT DOCUMENTS

| | | | | |
|---|---|---|---|---|
| 4,701,368 | A | 10/1987 | Kiuchi et al. | |
| 4,943,351 | A | 7/1990 | Wedel | |
| 5,368,697 | A * | 11/1994 | Steiner et al. | 162/360.2 |
| 5,611,892 | A | 3/1997 | Karvinen et al. | |
| 5,614,064 | A | 3/1997 | Nykopp | |
| 5,655,444 | A | 8/1997 | Kayser et al. | |
| 5,876,565 | A * | 3/1999 | Laapotti | 162/360.2 |

(Continued)

FOREIGN PATENT DOCUMENTS

DE 33 24 408 A1 2/1984

(Continued)

OTHER PUBLICATIONS

DE 100 48 700, Apr. 11, 2002, English language machine translation, EPO.*

(Continued)

*Primary Examiner*—Eric Hug
(74) *Attorney, Agent, or Firm*—Kratz, Quintos & Hanson, LLP

(57) ABSTRACT

The present invention relates to a smoothing press for a paper machine and a press for a paper machine with a smoothing press as well as a paper production method. At a final stage of a press section (2) of a paper machine, wet web (1) with one face thereof retained by elastic members (13, 14) is pressed by the nip section of a pair of press rolls (12*a*, 12*b*) having a surface formed from a rigid material.

4 Claims, 11 Drawing Sheets

U.S. PATENT DOCUMENTS 6,863,776 B2 * 3/2005 Begemann et al. ..... 162/205

FOREIGN PATENT DOCUMENTS

| | | | |
|---|---|---|---|
| DE | 44 02 629 | * | 1/1994 |
| DE | 100 48 700 | * | 4/2002 |
| EP | 0 400 843 | * | 5/1990 |
| JP | 59-21793 | | 2/1984 |
| JP | 61-35316 | | 8/1986 |
| JP | 61-252389 | | 11/1986 |
| JP | 3-45156 | | 7/1991 |
| JP | 8-81894 | | 3/1996 |
| JP | 8-246380 | | 9/1996 |
| JP | 8-510014 | | 10/1996 |
| JP | 10-298888 | | 11/1998 |

OTHER PUBLICATIONS

DE 44 02 629, Jan. 31, 1994, English language machine translation, EPO.*

Smook, G.A., Handbook for Pulp and Paper Technologists, Angus Wilde Publications, p. 253 (1992).*

Supplementary European Search Report dated Jan. 30, 2007.

"Mitsubishi-Beloit Press Achieves Productivity Increase/Increase in Quality/Energy Conservation/Power-Saving;" *Mitsubishi-Beloit Press*; pamphlet issued by Mitsubishi Heavy Industries, Ltd.; Sep. 1980; Six sheets and two sheets of translation (8 Sheets total.)/ Discussed in the specification.

* cited by examiner

PRESS FOR PAPER MACHINE WITH SMOOTHING PRESS, AND PAPER PRODUCTION METHOD

TECHNICAL FIELD

The present invention relates to a smoothing press for a paper machine and a press for a paper machine with a smoothing press as well as a paper production method.

BACKGROUND ART

FIGS. 9 and 10 are views illustrating conventional press apparatus for a common paper machine. FIG. 9 is a schematic view showing a configuration of a no-open draw type press of the press apparatus, and FIG. 10 is a schematic view showing a configuration of an open draw type press of the press apparatus.

It is to be noted that the no-open draw type press is a press configuration wherein a wet web 1 travels in a press section 2 of a paper machine in a state wherein the both faces or one face of the wet web 1 is always retained by a felt, a belt or the like as shown in FIG. 9. Meanwhile, the open draw type press is a press configuration wherein a wet web 1 travels in a press section 2 of the paper machine in a state wherein none of the both faces of the wet web 1 is always retained by a felt, a belt or the like as shown in FIG. 10.

As shown in FIG. 9, in a common no-open draw type press, a wet web 1 fed through a press or a former on the upstream side of a final water-removing press 4 of the paper machine is sucked by a suction roll 5*a* and retained on a felt 6*a*. Thereafter, the wet web 1 is transported in a state wherein it is sandwiched by the felt 6*a* and another felt 6*b* to the final water-removing press 4.

In the present example, the final water-removing press 4 includes a press roll (or shoe press) 4*a* and another press roll 4*b*, and utilizes a nip pressure of the press rolls 4*a* and 4*b* to transfer water content included in the wet web 1 to the felts 6*a* and 6*b* to perform water removal.

The wet web 1 dewatered by the final water-removing press 4 travels while it is sucked by a suction roll 5*b* and supported by the felt 6*b* until it is sucked by a suction roll 5*c* and supported by a canvas 7*a* and then carried to a dryer section 3. It is to be noted that, where a paper feeding (threading) belt which does not have air permeability and absorbs no water content at all is provided in place of the felt 6*b*, the suction roll 5*b* need not be provided.

Thereafter, the wet web 1 passes a first dryer 3*a*, a second dryer 3*b* and a third dryer 3*c* of the dryer section 3 in order, whereupon drying of the wet web 1 is performed. It is to be noted that reference character 7*a* in FIG. 9 denotes a canvas, and reference characters 20*a* and 20*b* in FIG. 9 denote each a vacuum roll.

Such a no-open draw type press as described above is disclosed, for example, in U.S. Pat. No. 5,611,892 (hereinafter referred to as Patent Document 1) and Japanese Published Examined Application No. HEI 3-45156 (U.S. Pat. No. 4,493,351: hereinafter referred to as Patent Document 2). Also in the techniques disclosed in Patent Documents 1 and 2, water removal is performed by a press section in a state wherein a wet web is retained by a felt or a belt (that is, no-open draw), and thereafter, the wet web is carried to a dryer section 3.

Meanwhile, as shown in FIG. 10, in a common open draw type press, a wet web 1 is dewatered by a nip section of press rolls 9*a* and 9*b* in a state wherein the wet web 1 is sandwiched by felts 6*c* and 6*d*. Thereafter, the wet web 1 is dewatered by a nip section of a press roll (center roll) 9*c* and another press roll 9*d* in a state wherein one face of the wet web 1 is retained by the felt 6*c*. Then, the wet web 1 is dewatered by a nip section of the press roll 9*c* and a further press roll (or shoe press) 9*e* in a state wherein the one face of the wet web 1 is supported by a felt 6*e*.

Thereafter, the wet web 1 is sucked by open draw by a suction roll 5*d* through a paper roll 18 and is then dewatered by a nip section of a press roll 4*c* and another press roll (or shoe press) 4*d* of the final water-removing press 4 in a state wherein one face of the wet web 1 is retained by a felt 6*f*. Thereafter, the wet web 1 is carried by open draw to a smoothing press 10 through the paper roll 8.

The smoothing press 10 is provided on the downstream side of the final water-removing press 4, and includes a press roll 10*a* having a soft cover (for example, a rubber skin) mounted on the surface thereof and a press roll 10*b* having a hard cover (skin harder than the soft cover) mounted on the surface thereof.

The smoothing press 10 generates a nip pressure lower than that of a normal press. Further, if the surface of one of the press rolls thereof is formed as a soft surface [approximately 85° to 95° in the type A of the JIS Standards (JIS K 6253)], then a nip width can be secured, and the smoothness of the surface of the wet web 1 can be enhanced in a state wherein the quantity (thickness or volume) of the wet web 1 is retained in the nip section of the smoothing press 10.

Such an open draw type press as described above is disclosed, for example, in a catalog [Mitsubishi-Beloit Press] (September 1980: hereinafter referred to as Non-Patent Document 1). Also in the technique of Non-Patent Document 1, a smoothing press is provided on the downstream side of a final water-removing press, and a wet web on the upstream side and the downstream side of the smoothing press is carried by open draw.

Incidentally, as described above, in the no-open draw type press, since the wet web 1 is retained by felts or belts, the wet web 1 can be fed with stability also upon high-speed operation. Further, damage to the wet web 1 can be prevented, and a paper feeding performance is enhanced.

However, in such a no-open draw type press as described above, there is the possibility that the smoothness of the surface of the wet web 1 which contacts with the felts 6*a* and 6*b* may be degraded.

Particularly recently, there is a tendency that the number of press apparatus in a press division is decreased. However, if the number of press apparatus is decreased, then the number of nip sections decreases, and as a result, the water removal efficiency in the press division drops. Therefore, while it is a possible idea to use a felt whose surface has fibers of an increased fiber diameter (butt diameter) to enhance the drainability, the smoothness of the surface of the wet web 1 is degraded still more. In particular, in a normal multi-stage type press, a felt whose surface layer has fibers of an increased fiber diameter (butt diameter) (14 to 18 d) is used for a press at the preceding stage attaching importance to the drainability while a felt whose surface has fibers of a smaller fiber diameter (butt diameter) (6 to 10 d) is used for a press at the succeeding stage attaching importance to the surface characteristic. However, also in such a configuration as described above, there is a tendency that the smoothness of paper on the felt side is lower (coarser) than that on the roll side. Particularly, where the number of press stages is decreased, functions of the drainability and the smoothness which are contrary to each other are required to the felt, and satisfaction of the functions only by the countermeasure on the felt side is difficult.

Therefore, in order to enhance the smoothness of the wet web 1 in the no-open draw type press, it is a possible idea to provide the smoothing press 10 described above on the downstream side of the final water-removing press 4. However, since the conventional smoothing press 10 is configured originally so that it can be applied only to an open draw type press, it is difficult to incorporate the smoothing press 10 as it is in the no-open draw type press.

Meanwhile, in the open draw type press described above, since the smoothing press 10 is provided, the smoothness of the wet web 1 can be enhanced. However, as shown in FIG. 11, if high-speed operation is performed, then apparatus vibration generally increases. Consequently, there is a subject that, since the surface of the soft cover press roll 10*a* of the smoothing press 10 is corrugated by the increased apparatus vibration and gives rise to generation of further violent vibration, the high-speed operation is difficult.

Further, in the open draw type press, an open draw portion of the wet web 1 is long on the upstream side and the downstream side of the smoothing press 10. Therefore, where high-speed operation is performed, the wet web 1 is likely to break at the open draw portion, and enhancement of the paper feeding performance is difficult.

In this manner, the conventional no-open draw type press and open draw type press individually have advantages and disadvantages, and particularly where it is tried to operate a paper machine at a higher speed, it is difficult to enhance the smoothness of the wet web 1 while the wet web 1 is carried with stability.

The present invention has been made in view of such subjects as described above, and it is an object of the present invention to provide a smoothing press for a paper machine and a press for a paper machine with a smoothing press as well as a paper production method which can enhance the paper feeding performance and the smoothness of a wet web also upon high-speed operation of a paper machine.

DISCLOSURE OF THE INVENTION

According to the present invention, a smoothing press for a paper machine which is provided as a press at a final stage of a press section of a paper machine and functions to smooth a surface of a traveling wet web comprises an elastic member for guiding traveling of the wet web while retaining one face of the wet web, a first press roll contacting with the other face of the wet web and having a surface formed from a rigid material, and a second press roll having a surface formed from a rigid material for cooperating with the first press roll through the elastic member to generate a nip pressure to press the wet web.

With the smoothing press for a paper machine of the present invention, since the second press roll whose surface is formed from a rigid material generates a nip pressure between the first press roll and the second press roll through the elastic member to press the wet web, the press roll is not corrugated and generation of vibration can be prevented. Consequently, a paper feeding performance and a smoothness of the wet web can be enhanced also upon high-speed operation of the paper machine.

Further, a shoe press is frequently applied to a no-open draw type press, and the smoothness of the wet web is inclined to degrade from a high water removal performance of the shoe press. However, with the present invention, the smoothing press can be used together with the shoe press, and the smoothness of the wet web can be enhanced also where the shoe press is applied.

Preferably, the elastic member is a paper feeding belt which does not have air permeability. Or, preferably the elastic member is a surface property improving felt having air permeability.

Preferably, the hardness of the surfaces of the first press roll and the second press roll is within a range from JIS 99° to JIS 100°.

According to the present invention, a first press configuration for a paper machine with the smoothing press which includes the smoothing press wherein the elastic member described above is the paper feeding belt comprises a carrying belt provided on the upstream side of the smoothing press for carrying the wet web from a final water-removing press of the press section to the smoothing press and a pair of nip transfer rolls provided on the upstream side of the smoothing press for generating, in a state wherein the wet web is held between the carrying belt and the paper feeding belt, a nip pressure on the wet web, the hardness of the paper feeding belt being set higher than that of the carrying belt.

With the first press configuration for a paper machine with a smoothing press of the present invention, since the hardness of the paper feeding belt is set higher than that of the carrying belt. Therefore, if the nip pressure is applied to the wet web by the nip transfer rolls, then the wet web can be transferred from the carrying belt to the paper feeding belt which has the higher hardness.

According to the present invention, a second press configuration for a paper machine with the smoothing press which includes the smoothing press wherein the elastic member is the surface characteristic improving felt comprises a carrying felt provided on the upstream side of the smoothing press for carrying the wet web from a final water-removing press of the press section to the smoothing press and a suction roll provided on the upstream side of the smoothing press for sucking the wet web on the carrying felt through the surface characteristic improving felt.

With the second press configuration for a paper machine with a smoothing press of the present invention, the wet web is sucked through the surface characteristic improving felt having the air permeability. Therefore, the wet web can be transferred from the carrying felt to the surface characteristic improving felt.

According to the present invention, a paper production method is configured such that, in order to smooth a surface of a traveling wet web in a press at a final stage of a press section of a paper machine, the wet web is pressed by a nip section of a pair of press rolls having surfaces formed from a rigid material in a state wherein one face of the wet web is retained by an elastic member.

With the paper production method of the present invention, the wet web is pressed, in a state wherein one face of the wet web is retained on the elastic member, by the pair of press rolls whose surfaces are formed from a rigid material. Therefore, the press rolls are not corrugated, and generation of vibration can be prevented. As a result, the paper feeding performance and the smoothness of the wet web can be enhanced also upon high-speed operation of a paper machine.

It is to be noted that the smoothing press in the present invention is a pair of rolls provided as a press at a final stage of a press section of a paper machine, and is provided in order to implement enhancement of the smoothness of the face of the wet web. Further, since the smoothness of the wet web is improved by the present invention, the present invention is suitable particularly for use with production of paper for which the smoothness is required such as good quality paper, enamel paper, paper board and so forth. However, the application of the present invention is not limited to this.

BEST MODE FOR CARRYING OUT THE INVENTION

In the following, embodiments of the present invention are described with reference to the drawings.

(A) First Embodiment

Figure 1:
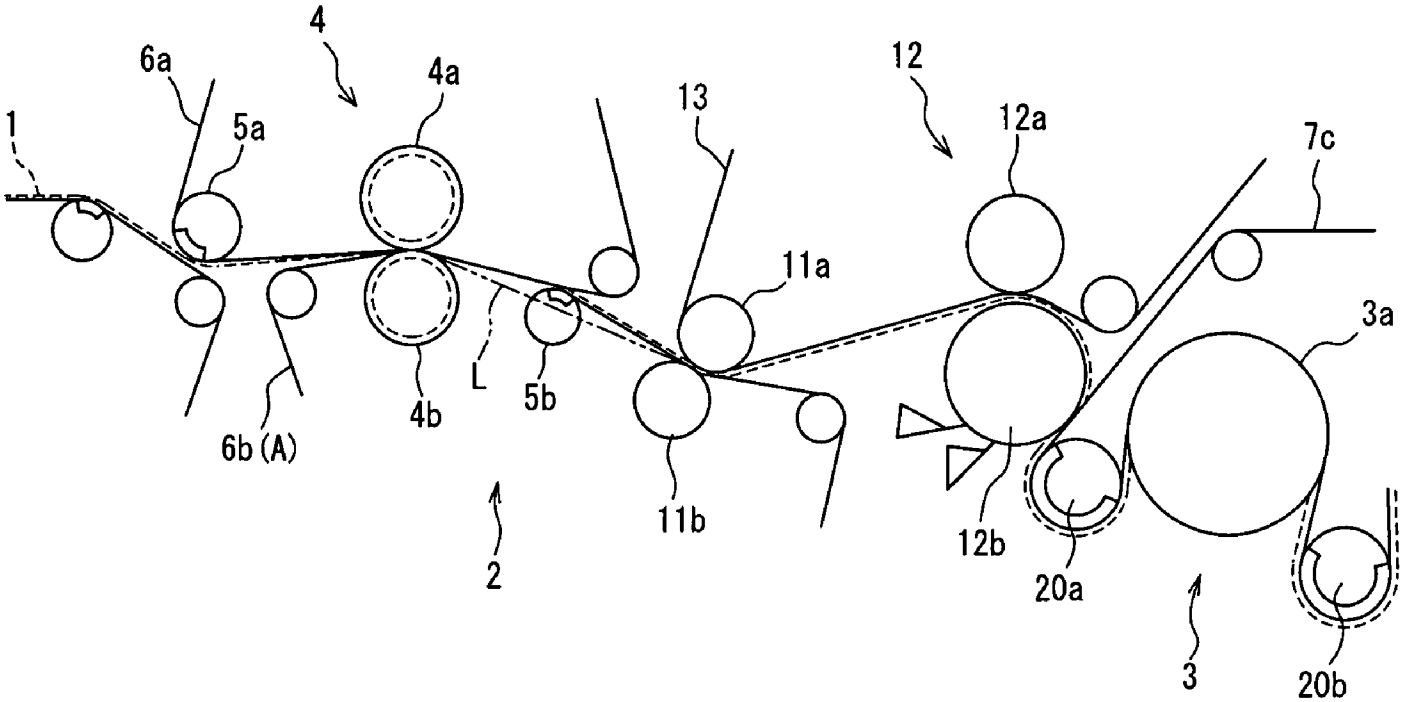
FIG. 1 is a schematic view showing a configuration of a press for a paper machine with a smoothing press as a first embodiment of the present invention.

FIG. 1 is a schematic view showing a configuration of a press apparatus (a press) for a paper machine with a smoothing press as a first embodiment of the present invention. It is to be noted that, in FIG. 1, like elements to those of the conventional examples described hereinabove are denoted by like reference characters.

As shown in FIG. 1, a smoothing press 12 provided in the present press apparatus for a paper machine is provided as a press at a final stage of a press section 2 of a paper machine. Here, the smoothing press 12 is provided on the downstream side of a final press apparatus (hereinafter referred to as final water-removing press) 4 in the press section 2 for performing water removal of a wet web 1.

It is to be noted that the final water-removing press 4 here includes a press roll (or shoe press) 4*a* and another press roll 4*b*, and utilizes a nip pressure of the press rolls 4*a* and 4*b* to transfer water content included in the wet web 1 to the felts 6*a* and 6*b* to perform water removal.

The present smoothing press 12 includes a press roll (second press roll) 12*a* and another press roll (first press roll) 12*b* provided in pair on the upper side and the lower side of a traveling pass of the wet web 1 and each having a surface formed from a rigid material (a material on which a hard cover of rigid rubber or the like is mounted, or natural stone represented by a stone roll, man-made stone and so forth), and a paper feeding belt 13 as an elastic member. It is to be noted that preferably the hard cover (that is, the surface of each of the press rolls 12*a* and 12*b*) described above has a hardness within a range from 99° to 100° in the type A in the JIS Standards (JIS K 6253).

The press rolls 12*a* and 12*b* generate a nip pressure to the wet web 1 through the paper feeding belt 13. It is to be noted that the paper feeding belt 13 is, for example, a rubber belt, and has a very smooth surface in comparison with a normal felt and does not have the air permeability (absorbs no water content at all).

If the paper feeding belt 13 having such a configuration as described above is sandwiched by the press rolls 12*a* and 12*b* such that the press rolls 12*a* and 12*b* generate a nip pressure, then elastic deformation appears with the paper feeding belt 13 in the nip section. Consequently, the nip width can be secured.

Further, the paper feeding belt 13 is fed to a nip section of a pair of nip transfer rolls 11*a* and 11*b* provided on the upstream side of the press rolls 12*a* and 12*b*, and the wet web 1 retained by the felt 6*b* and carried from the final water-removing press 4 is transferred to the paper feeding belt 13 in the nip section of the nip transfer rolls 11*a* and 11*b*.

Normally, where the nip pressure is applied, the wet web 1 sticks to and moves together with a smoother surface. Therefore, if the nip pressure is applied between the nip transfer rolls 11*a* and 11*b* in a state wherein the wet web 1 is sandwiched by the paper feeding belt 13 and the felt 6*b*, then the wet web 1 sticks to the paper feeding belt 13 having the surface smoother than that of the felt 6*b*. Consequently, the traveling path of the wet web 1 is changed from the surface of the felt 6*b* to the surface of the paper feeding belt 13.

Since the smoothing press for a paper machine of the present embodiment is configured in such a manner as described above, the wet web 1 transferred through the press or former on the upstream side of the final water-removing press 4 is sucked by a suction roll 5*a* and is retained at one face thereof by a felt 6*a* as shown in FIG. 1. Then, the wet web 1 is carried to the final water-removing press 4 in a state wherein it is sandwiched by the felts 6*a* and 6*b* so that water removal thereof is performed by the final water-removing press 4.

Thereafter, the wet web 1 is sucked by the suction roll 5*b* and is retained at one face thereof by the felt 6*b*. Then, the nip pressure is applied to the wet web 1 in the nip section of the nip transfer rolls 11*a* and 11*b* in a state wherein the wet web 1 is sandwiched by the felt 6*b* and the paper feeding belt 13. Then, the wet web 1 is transferred from the felt 6*b* to the paper feeding belt 13.

It is to be noted that a paper feeding belt A may be used in place of the felt 6*b*. In this instance, naturally the paper feeding belt A is formed from a rubber belt or the like whose surface is much smoother than that of a normal felt and which does not have air permeability (absorbs no water content at all). If such a configuration as described above is applied, then, in the nip section of the final water-removing press 4, the wet web 1 sticks to and moves together with the paper feeding belt A having the surface smoother than that of the felt 6*a*. Therefore, the suction roll 5*b* need not be provided (that is, in this instance, the wet web travels on an alternate long and two short dashes line denoted by a reference character L in FIG. 1). However, it is necessary to degrade the smoothness of the surface of the paper feeding belt A used in place of the felt 6*b* described above when compared with that of the paper feeding belt 13 which is a carrying destination of a wet web or to set the hardness of the paper feeding belt A lower than that of the paper feeding belt 13.

In particular, as described above, the wet web 1 has a nature that, when the nip pressure is applied, it sticks to a smoother surface and has another nature that it sticks to an element having higher hardness. Accordingly, for example, where the surface of the paper feeding belt A and the surface of the paper feeding belt 13 have a substantially equal smoothness, if the paper feeding belt A is formed as a belt having hardness lower than that of the paper feeding belt 13, then the wet web 1 sticks to and moves together with the paper feeding belt 13 having hardness higher than the belt described above when the nip pressure is applied thereto between the nip transfer rolls 11*a* and 11*b*.

The wet web 1 having carried through the nip transfer rolls 11*a* and 11*b* is acted upon by the nip pressure in the nip section of the press rolls 12*a* and 12*b* in a state wherein one face (in FIG. 1, an upper face of the wet web) of the wet web 1 is retained by the paper feeding belt 13. Then a smoothing process of the both faces of the wet web 1 is performed.

Thereafter, the wet web 1 is transferred to a dryer section 3 through a canvas 7*c*, and passes a second dryer and a third dryer not shown in order from a first dryer 3*a* to perform drying of the wet web 1. It is to be noted that reference characters 20*a* and 20*b* in FIG. 1 denote each a vacuum roll.

In this manner, in the present smoothing press 12, the paper feeding belt 13 interposed between the press rolls 12*a* and 12*b* is elastically reformed such that the nip width can be secured. Therefore, such a soft cover press roll as in the conventional example need not be used. In particular, since a situation does not appear that a press roll is corrugated as in such a smoothing press as in the conventional example, generation of vibration can be prevented.

Further, a smoothing press which can be placed conventionally only in the open draw type press can be placed in the no-open draw type press. Since there is no open draw portion, the paper feeding performance is high, and the wet web 1 can be carried with stability also upon high-speed operation. In other words, the paper machine can be operated at a higher speed, and the paper feeding performance and the smoothness of the wet web 1 can be enhanced also upon high-speed operation of the paper machine.

As a result, there are advantages also that the load to a calender equipment (not shown) disposed on the downstream side of the dryer section 3 for performing of surface treatment of the wet web 1 can be reduced, and particularly, bulky paper can be easily produced.

Further, in a conventional no-open draw type press, a shoe press is applied frequently, and, from a high water removal performance of the shoe press, the smoothness of the wet web 1 is inclined to degrade. However, according to the present invention, a smoothing press can be used together with the shoe press, and the smoothness of the wet web 1 can be improved where the shoe press is applied.

(A-1) Modification 1

Figure 2:
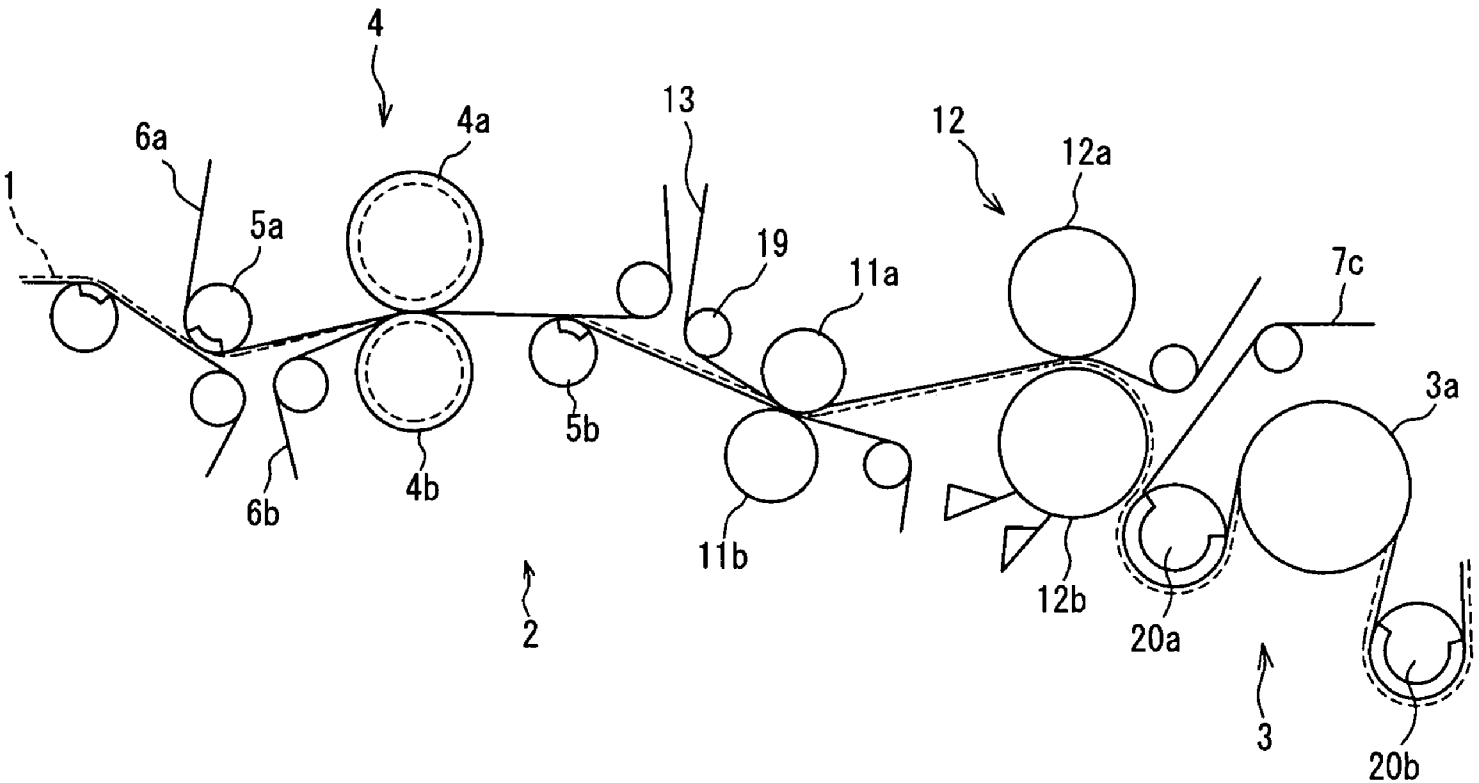
FIG. 2 is a schematic view illustrating a modification 1 to the first embodiment of the present invention.

FIG. 2 is a schematic view illustrating a configuration of a modification 1 to the first embodiment. Differences of the modification 1 from the first embodiment are described below.

As shown in FIG. 2, in the modification 1, a guide roll 19 is provided on the upstream side of the nip transfer rolls 11*a* and 11*b*, and the paper feeding belt 13 is inserted into the nip section of the nip transfer rolls 11*a* and 11*b* past the guide roll 19.

In particular, the modification 1 is configured such that a traveling line of the paper feeding belt 13 just before the nip section of the nip transfer rolls 11*a* and 11*b* is changed by the guide roll 19. Consequently, since a sharp bent of the paper feeding belt 13 upon traveling along the nip transfer rolls 11*a* and 11*b* can be moderated, expansion and contraction of the paper feeding belt 13 just before and after of the nip section can be prevented.

Consequently, wrinkles of the wet web 1 can be prevented. Further, since the wet web 1 can be retained with certainty on the paper feeding belt 13, the carrying operation can be performed with stability also after the wet web 1 passes the nip section.

(A-2) Modification 2

Figure 3:
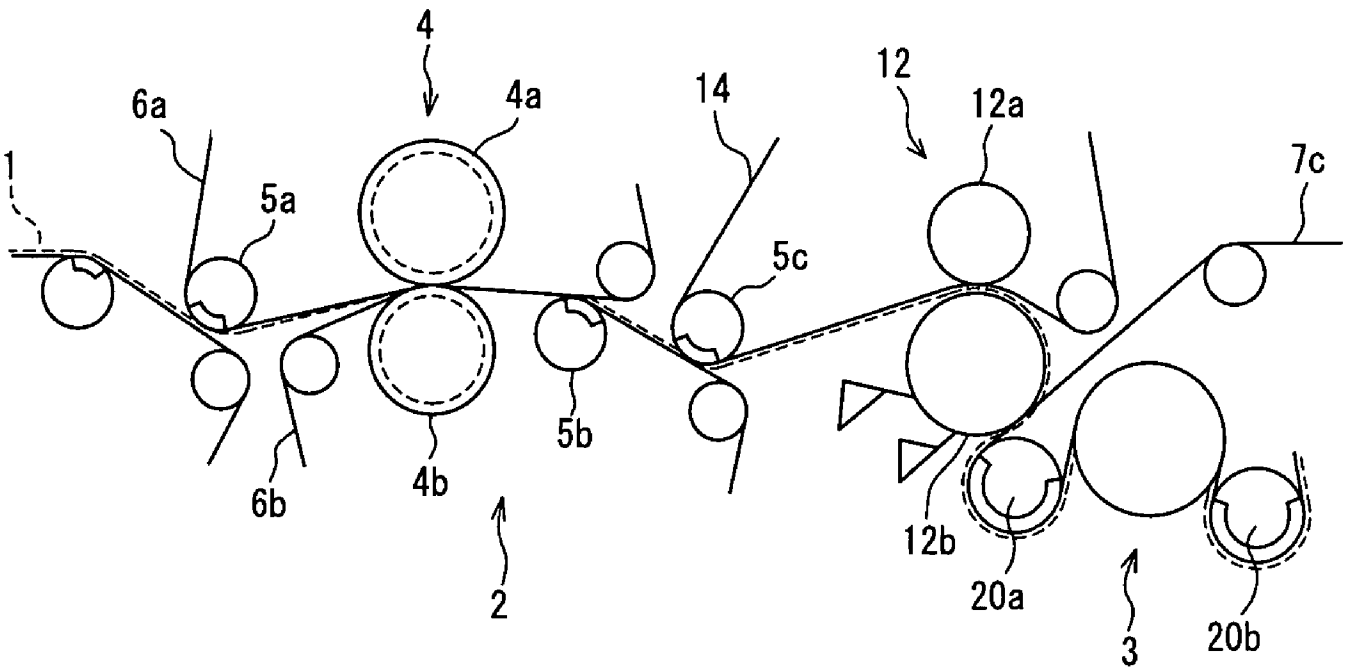
FIG. 3 is a schematic view illustrating a modification 2 to the first embodiment of the present invention.

FIG. 3 is a schematic view illustrating a configuration of a modification 2 to the first embodiment. Differences of the modification 2 from the first embodiment are described below.

As shown in FIG. 3, in the modification 2, a felt 14 for improving a surface performance is provided in place of the paper feeding belt 13, and a suction roll 5*c* is provided in place of the nip transfer rolls 11*a* and 11*b*.

While the surface performance improving felt 14 has the air permeability, the surface of the felt 14 is formed much smoother than that of a normal water removing felt, and the felt 14 functions to smooth the surface of the wet web 1 similarly to the paper feeding belt 13. While a normal water removing felt has an air permeability of approximately 20 cc/(sec·cm$^2$), the air permeability of the surface performance improvement felt 14 in the present invention is set to 10 cc/(sec·cm$^2$) or less.

Consequently, the wet web 1 carried by and retained on the felt 6*b* is sucked by the suction roll 5*c* and transferred to the surface performance improvement felt 14, and then, smoothing of the surface of the wet web 1 is performed in the nip section of the press rolls 12*a* and 12*b*. At this time, since the surface performance improving felt 14 having the air permeability lower than that of a normal water removing felt is used as described above, not only the smoothness of the face of the wet web 1 on the press roll 12*b* side but also the smoothness of the face of the wet web 1 on the surface performance improving felt 14 side can be enhanced.

Further, since the nip transfer rolls 11*a* and 11*b* shown in FIG. 1 need not be provided, the space can be reduced.

(A-3) Modification 3

Figure 4:
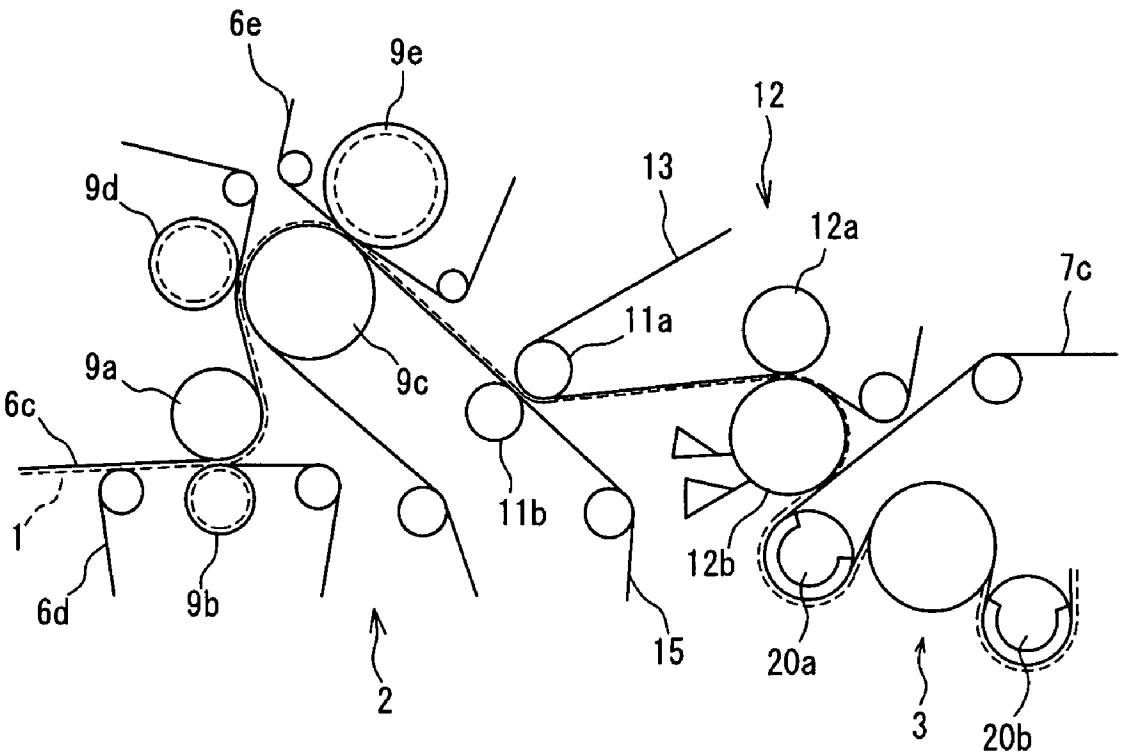
FIG. 4 is a schematic view illustrating a modification 3 to the first embodiment of the present invention.
Figure 10:
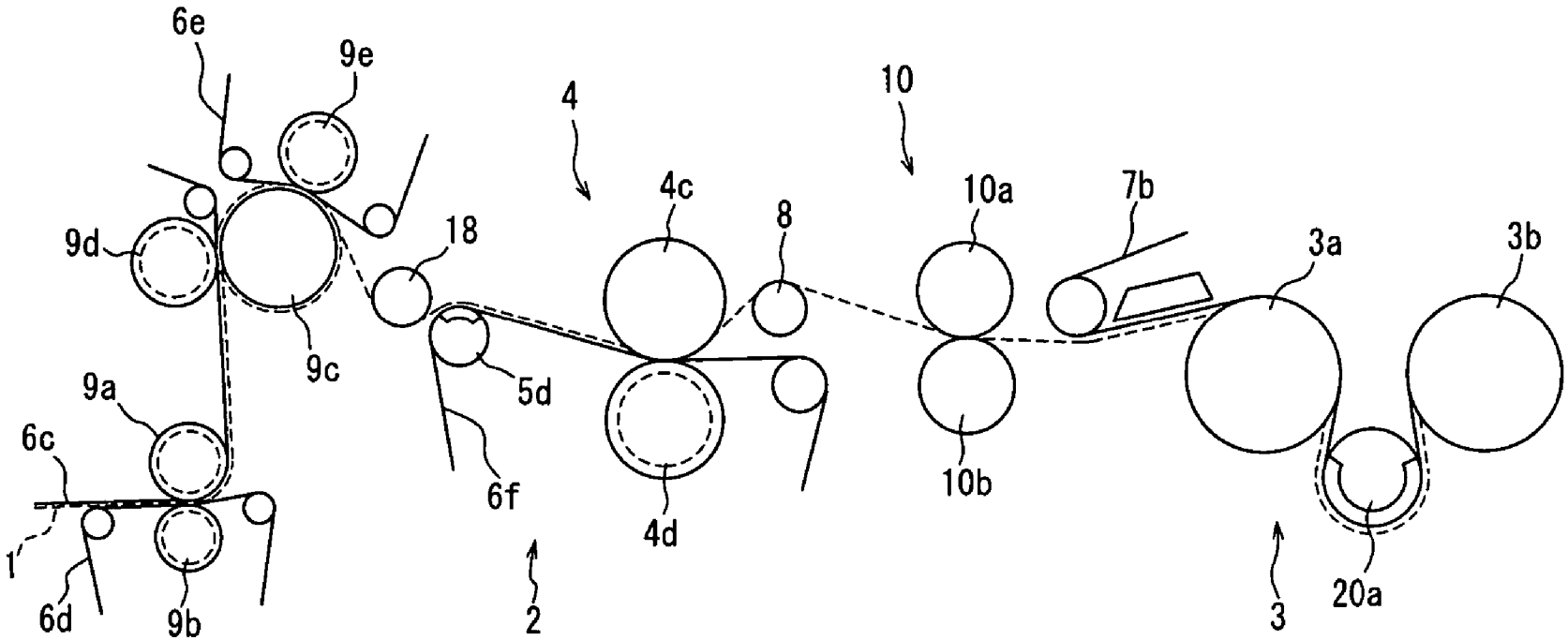
FIG. 10 is a view schematically showing a configuration of a conventional common open draw type press.
Figure 11:
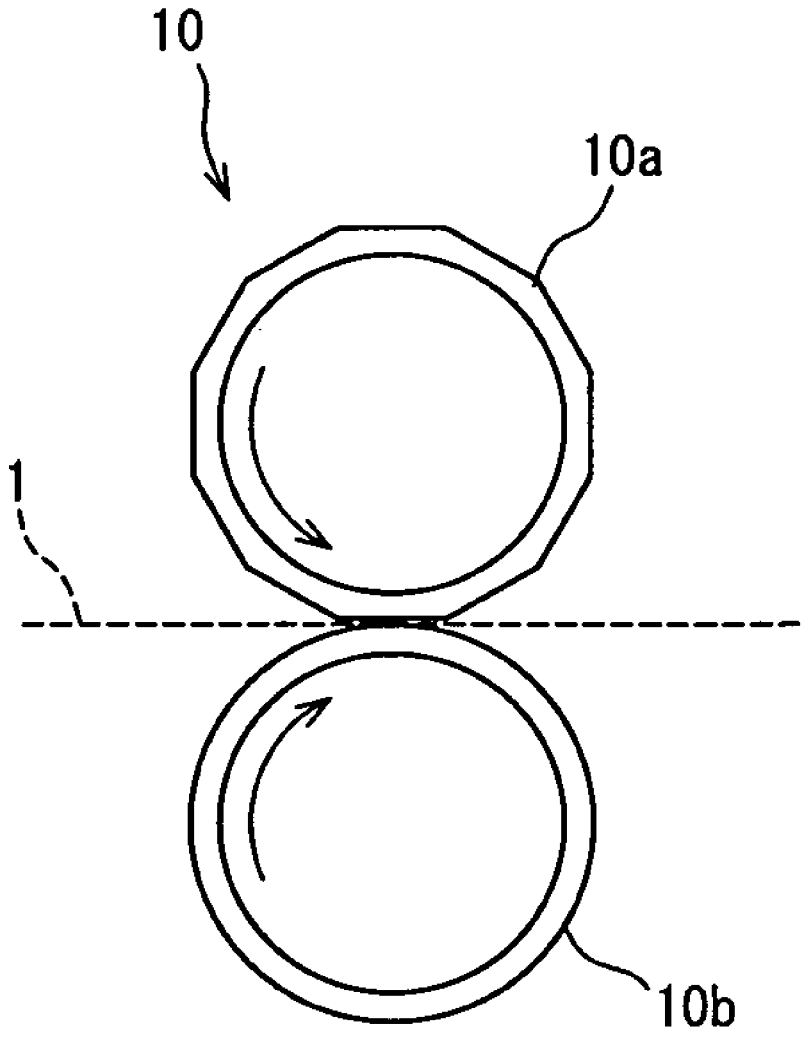
FIG. 11 is a view schematically showing a configuration of a conventional smoothing press.

FIG. 4 is a view illustrating a modification 3 to the first embodiment, and shows a schematic configuration where the smoothing press of the first embodiment is applied to the conventional press apparatus for a paper machine shown in FIG. 10.

As shown in FIG. 4, in the modification 3, a paper feeding belt 15 having a smoothness or a hardness lower than that of the paper feeding belt 13 is stretched on the press roll 9*c*, and the wet web 1 retained on the paper feeding belt 15 is transferred to the paper feeding belt 13 by the nip transfer rolls 11*a* and 11*b*.

Consequently, the wet web 1 is dewatered in the nip section of the press rolls 9*a* and 9*b* in a state wherein it is sandwiched by the felts 6*c* and 6*d*, and thereafter the wet web 1 is dewatered in a nip section of the press rolls 9*c* and 9*b* and a nip section of the press roll 9*c* and another press roll (or shoe press) 9*e*.

Thereafter, the wet web 1 is acted upon by the nip pressure from the nip transfer rolls 11*a* and 11*b* in a state wherein it is retained on the paper feeding belt 15 (no-open draw) and is transferred to the paper feeding belt 13. Then, smoothing of the surface of the wet web 1 is performed by the press rolls 12*a* and 12*b*.

In this manner, where the configuration that the paper feeding belt 15 is stretched on the press roll 9*c* and the wet web 1 is carried by the nip transfer rolls 11*a* and 11*b* is applied, the modification 3 can be applied also to such a conventional press apparatus (cluster press) for a paper machine as shown in FIG. 10. Also it is possible to apply a surface performance improving belt in place of the paper feeding belt 13 and apply a suction roll in place of the nip transfer rolls 11*a* and 11*b*.

(B) Second Embodiment

Figure 5:
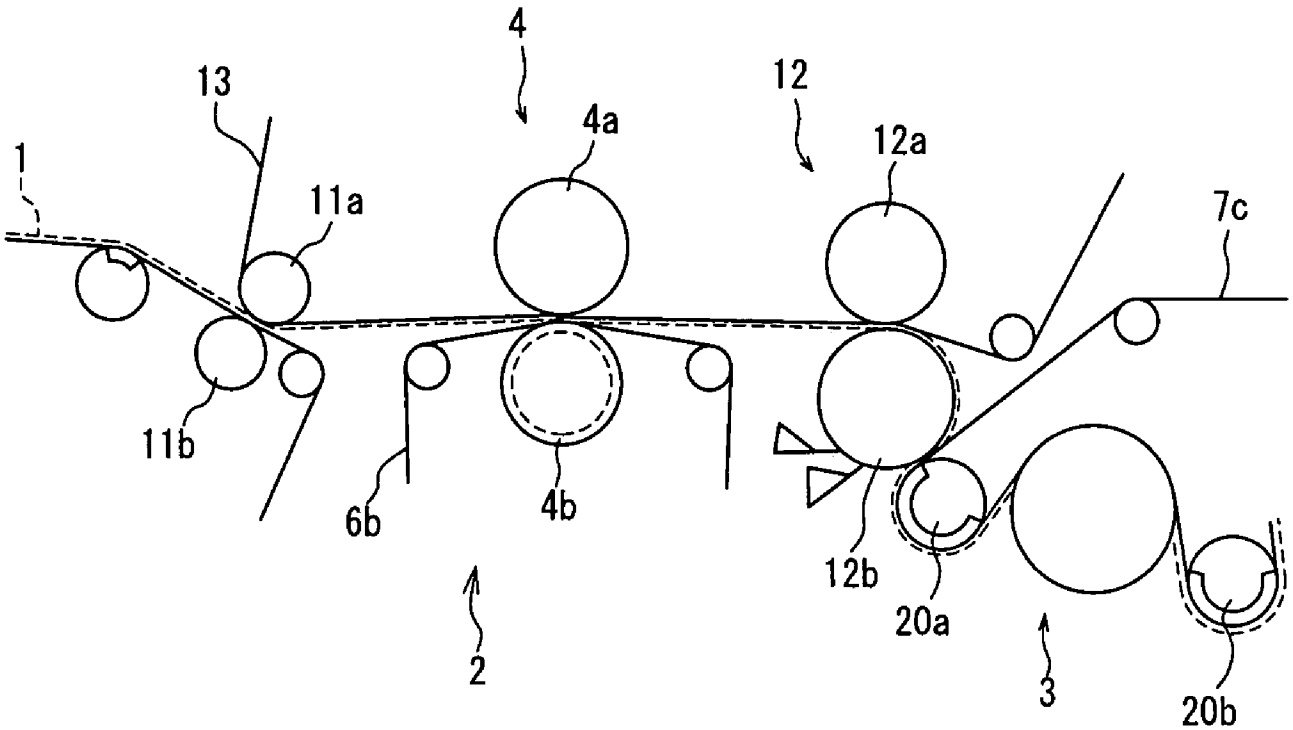
FIG. 5 is a schematic view showing a configuration of a press for a paper machine with a smoothing press as a second embodiment of the present invention.

FIG. 5 is a schematic view showing a configuration of a press apparatus for a paper machine with a smoothing press as a second embodiment of the present invention.

Differences from the first embodiment are described below.

As shown in FIG. 5, in a smoothing press 12 provided in the press apparatus for a paper machine, the paper feeding belt 13 is stretched not only on the press roll 12*a* but also on a nip section of the final water-removing press 4.

Further, nip transfer rolls 11*a* and 11*b* are provided on the upstream side of the final water-removing press 4, and, by the nip transfer rolls 11*a* and 11*b*, the wet web 1 carried through a press or former on the upstream side of the final water-removing press 4 is carried to the paper feeding belt 13.

Since the smoothing press for a paper machine of the present embodiment is configured in such a manner as described above, as shown in FIG. 5, the wet web 1 carried through the press or former on the upstream side of the final water-removing press 4 is transferred from a felt to the paper feeding belt 13 by the nip transfer rolls 11*a* and 11*b*. Then, water removal of the wet web 1 is performed by the nip section of the final water-removing press 4 in a state wherein the wet web 1 is sandwiched by the felt 6*b* and the paper feeding belt 13.

Then, the wet web 1 is carried into the nip section between the press rolls 12*a* and 12*b* of the smoothing press in a state wherein it is retained on the paper feeding belt 13, and smoothing of the surface of the wet web 1 is performed in the nip section. Thereafter, the wet web 1 is transferred to and dried in the dryer section 3.

In this manner, with the present press apparatus for a paper machine, since the suction rolls 5*a* and 5*b*, the felt 6*a* and so forth (refer to FIG. 1) in the first embodiment are not required, in addition to the effects by the first embodiment, the cost can be reduced and the apparatus can be made compact.

(B-1) Modification 1

Figure 6:
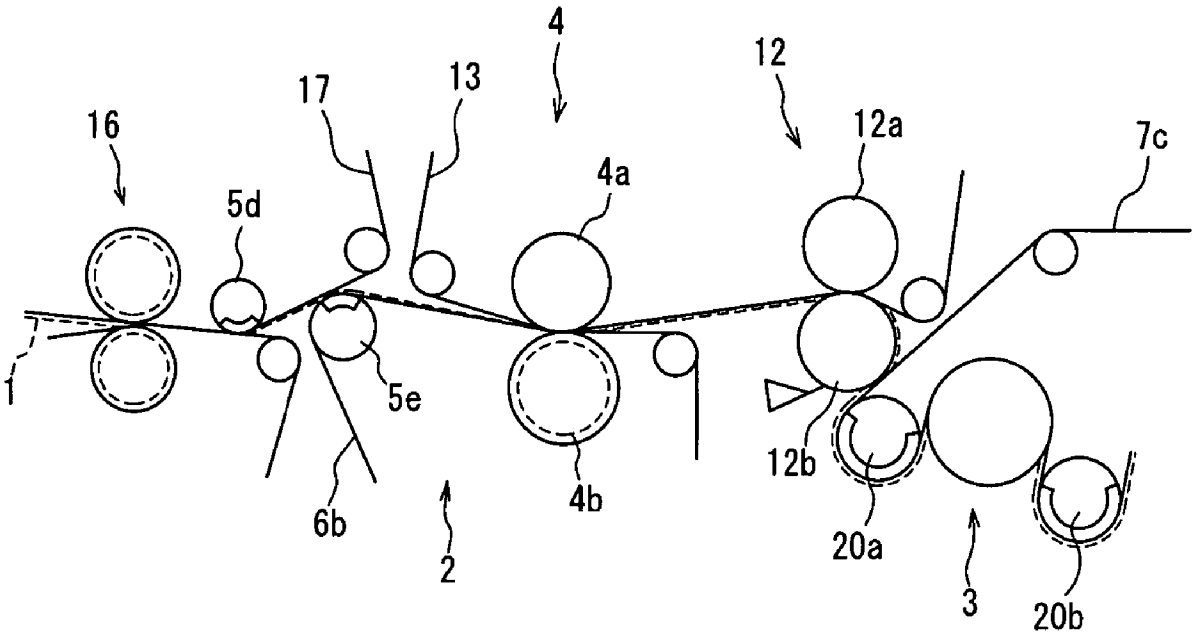
FIG. 6 is a schematic view illustrating a modification 1 to the second embodiment of the present invention.

FIG. 6 is a schematic view illustrating a configuration of a modification 1 to the second embodiment. Differences from the second embodiment are described below.

As shown in FIG. 6, the modification 1 includes a suction roll 5*d* for sucking the wet web 1 carried from a preceding stage press 16 on the upstream side of the final water-removing press 4, a felt 17 for retaining and carrying the wet web 1 sucked by the suction roll 5*d*, and a suction roll 5*e* for sucking and transferring the wet web 1 retained on the felt 17 to the felt 6*b* in place of the nip transfer rolls 11*a* and 11*b*.

(B-2) Modification 2

Figure 7:
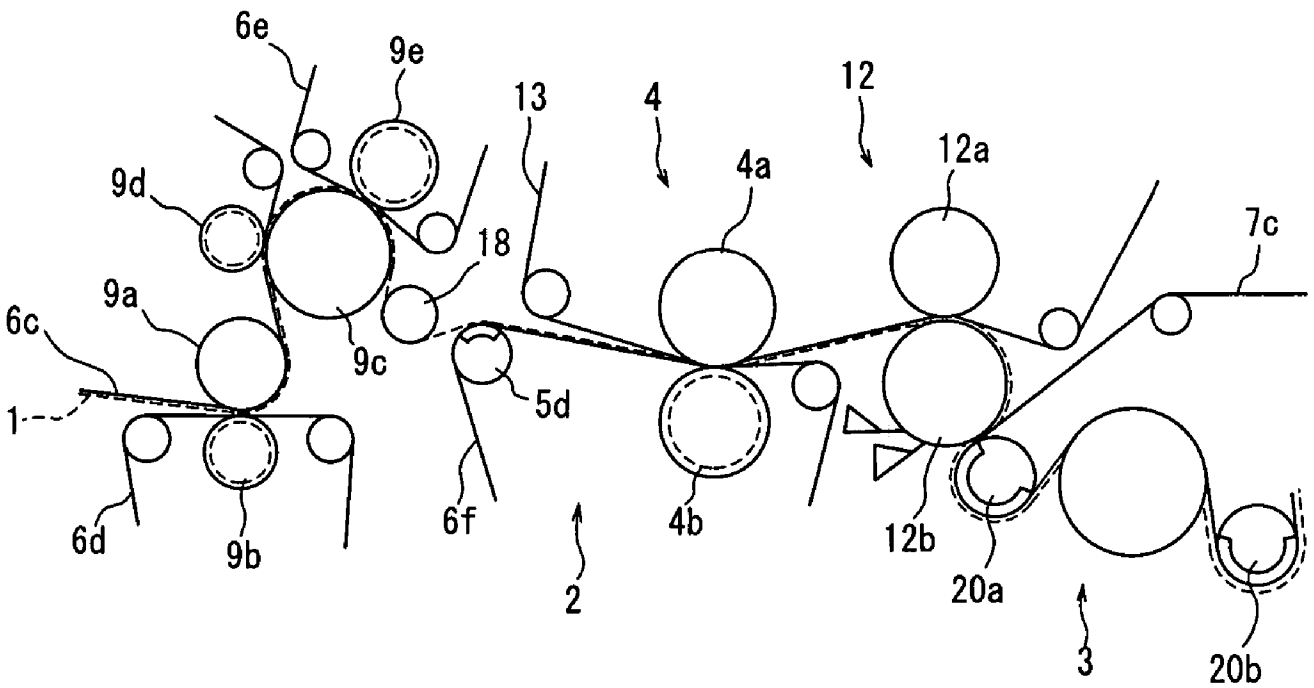
FIG. 7 is a schematic view illustrating a modification 2 to the second embodiment of the present invention.

FIG. 7 is a view illustrating a modification 2 to the second embodiment, and shows a schematic configuration where the smoothing press of the second embodiment is applied to the conventional press apparatus for a paper machine shown in FIG. 10.

As shown in FIG. 7, in the modification 2, the wet web 1 passes a nip section between the press roll 9*c* and the press roll 9*e* and is carried by open draw to the felt 6*f* through the paper roll 18. Then, the wet web 1 is dewatered by the final water-removing press 4 in a state wherein it is retained on the felt 6*f* and the paper feeding belt 13, and thereafter, smoothing of the surface of the wet web 1 is performed by the smoothing press 12 in a state wherein the wet web 1 is retained at one face thereof on the paper feeding belt 13.

Where the modification 2 is configured in such a manner as just described, an open draw portion can be reduced significantly, and a paper feeding performance of the wet web 1 can be enhanced.

(B-3) Modification 3

Figure 8:
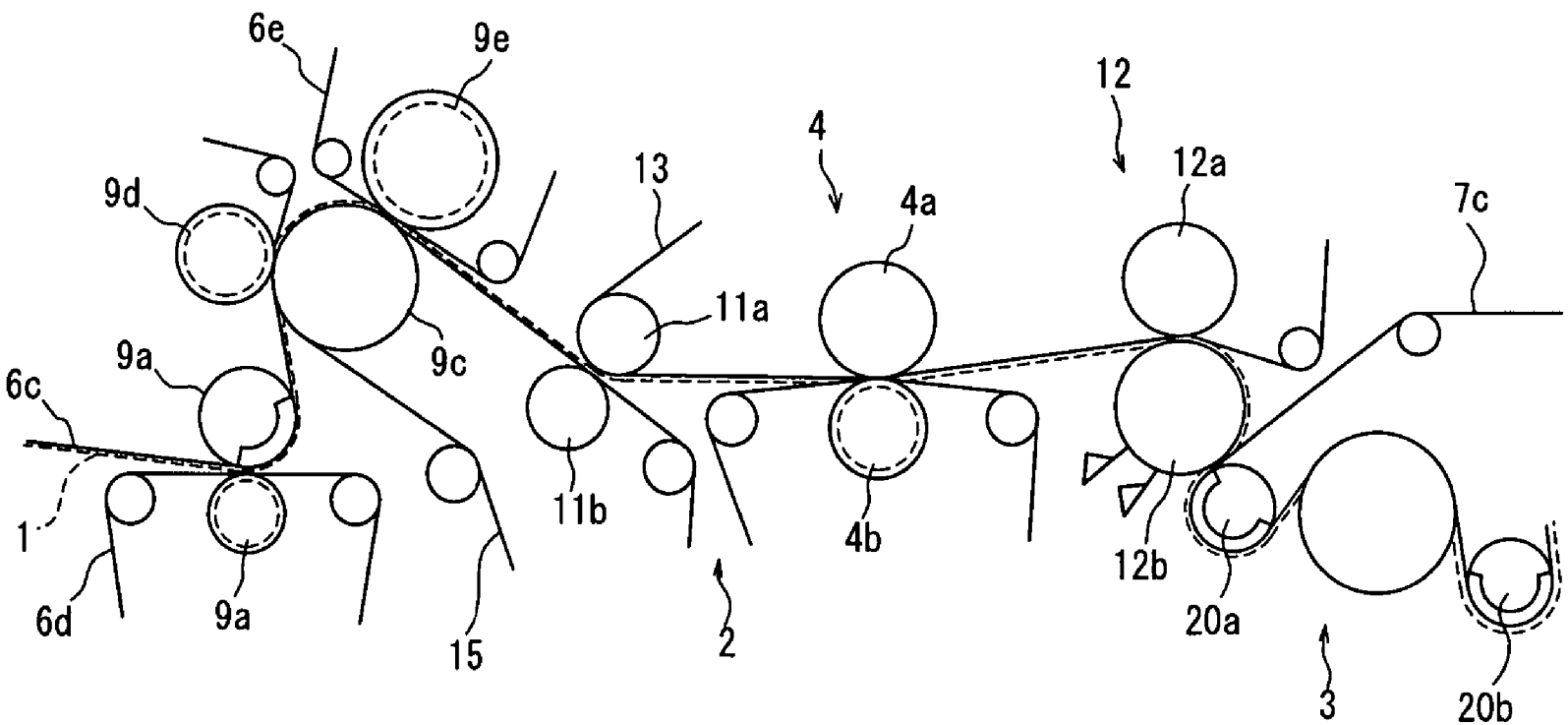
FIG. 8 is a schematic view illustrating a modification 3 to the second embodiment of the present invention.
Figure 9:
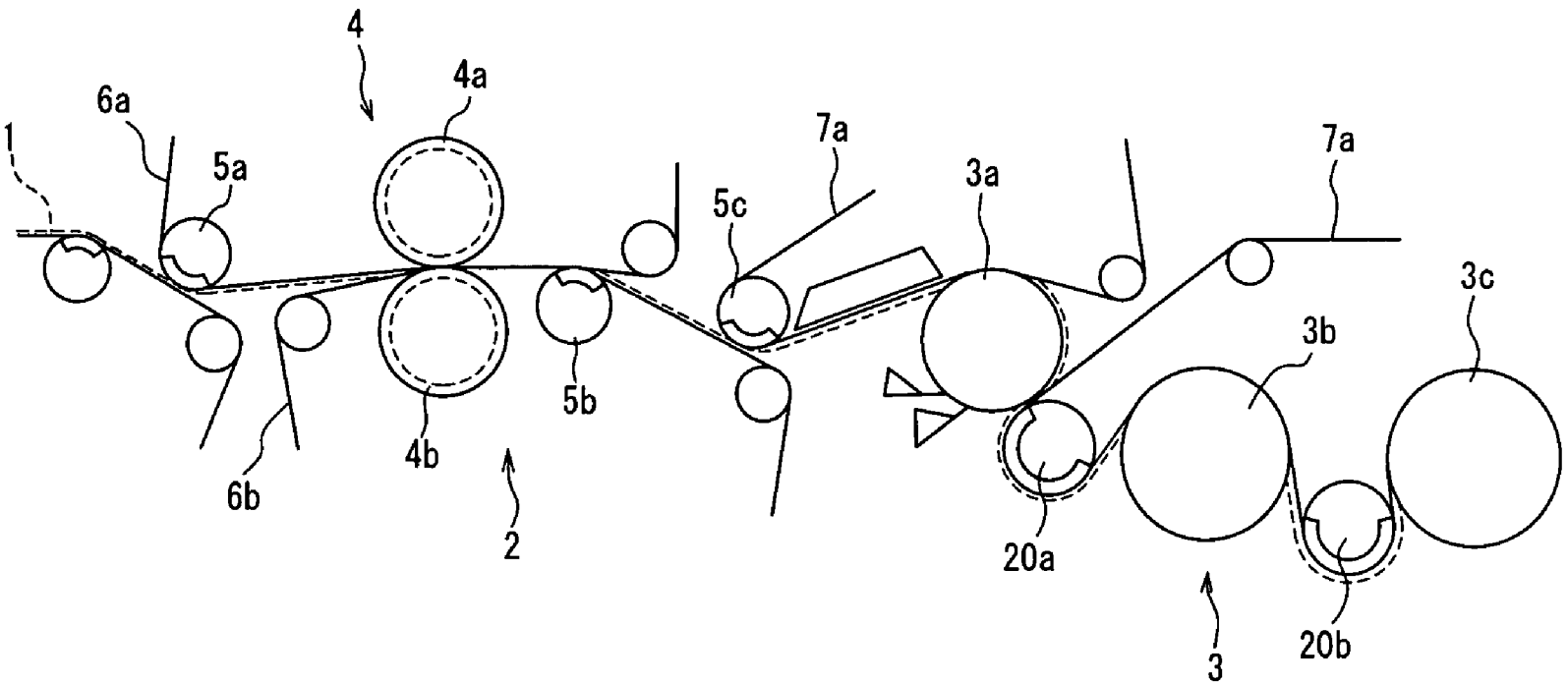
FIG. 9 is a view schematically showing a configuration of a conventional common no-open draw type press.

FIG. 8 illustrates a modification 3 to the second embodiment, and is a schematic view showing a configuration where the smoothing press of the second embodiment is applied to the conventional press apparatus for a paper machine shown in FIG. 10.

As shown in FIG. 8, in the modification 3, a paper feeding belt 15 having a hardness lower than that of the paper feeding belt 13 is stretched on the press roll 9*c*.

Accordingly, after the wet web 1 passes the nip section between the press roll 9*c* and the press roll (or shoe press) 9*e*, it is acted upon by the nip pressure from the nip transfer rolls 11*a* and 11*b* in a state wherein it is retained on the paper feeding belt 15 (no-open draw) and is transferred to the paper feeding belt 13. Thereafter, water removal of the wet web 1 is performed by the final water-removing press 4, and smoothing of the surface of the wet web 1 is performed by the smoothing press 12 in a state wherein the wet web 1 is retained at one face thereof on the paper feeding belt 13.

In this manner, if the configuration is applied wherein the paper feeding belt 15 is stretched on the press roll 9*c* and the wet web 1 is transferred by the nip transfer rolls 11*a* and 11*b*, then the modification 3 can be applied also to the conventional press apparatus for a paper machine shown in FIG. 10.

(C) Others

While embodiments of the present invention are described, the present invention is not limited to the embodiment specifically described above, and variations and modifications can be made without departing from the scope of the present invention.

For example, in the embodiments described above, a hard cover is mounted on the surface of each of the press rolls 12*a* and 12*b* of the smoothing press. However, the surface of the press roll itself may be formed so as to have a high hardness such that the surface of the wet web 1 may be smoothed directly by the surface of the press roll without using a cover.

INDUSTRIAL APPLICABILITY

As described above, with the smoothing press of the present invention, a press roll is not corrugated also upon high-speed operation of a paper machine, and generation of vibration can be prevented. Consequently, the paper feeding performance and the smoothness of a wet web can be enhanced, and therefore, the availability of the present invention is very high.

The invention claimed is:

1. A press for a paper machine with a smoothing press which is provided as a press at a final stage of a press section of a paper machine and functions to smooth a surface of a traveling wet web, said press comprising:

the smoothing press comprising:

an elastic member for guiding traveling of the wet web while retaining one face of the wet web;

a first press roll contacting with the other face of the wet web and having a surface formed from a rigid material; and a second press roll having a surface formed from a rigid material for cooperating with said first press roll through said elastic member to generate a nip pressure to press the wet web;

a carrying belt provided on the upstream side of said first press roll and said second press roll for carrying the wet web from a final water-removing press of said press section to said elastic member; and a pair of nip transfer rolls provided on the upstream side of said first press roll and said second press roll for generating, in a state wherein the wet web is held between said carrying belt and said elastic member, a nip pressure on the wet web; wherein said elastic member is a paper feeding belt which does not have air permeability and whose hardness is set higher than that of said carrying belt.

2. The press as set forth in claim 1, wherein the hardness of the surfaces of said first press roll and said second press roll is within a range from JIS 99° to JIS 100°.

3. A press for a paper machine with a smoothing press which is provided as a press at a final stage of a press section of a paper machine and functions to smooth a surface of a traveling wet web, said press comprising:

the smoothing press comprising:

an elastic member for guiding traveling of the wet web while retaining one face of the wet web;

a first press roll contacting with the other face of the wet web and having a surface formed from a rigid material; and a second press roll having a surface formed from a rigid material for cooperating with said first press roll at a nip section to generate a nip pressure to press the wet web through said elastic member, wherein said elastic member is deformed by applying said nip pressure between said first press roll and second press roll; and a canvas for transferring said wet web traveling on said first press roll downstream of said nip section to a dryer section; wherein said elastic member is a paper feeding belt which does not have air permeability.

4. A paper production method, wherein, in order to smooth a surface of a traveling wet web in a press at a final stage of a press section of a paper machine, the wet web is carried by a carrying belt from a final water-removing press of said press section to a paper feeding belt which does not have air permeability, is formed from an elastic member and have higher hardness than that of said carrying belt; at this time the wet web is applied a nip pressure by a pair of nip transfer rolls in a state wherein the wet web is held between said carrying belt and said paper feeding belt, to stick to said paper feeding belt; thereafter the wet web is carried by said paper feeding belt to a pair of press rolls having surfaces formed from a rigid material; and thereafter the wet web is pressed by a nip section of said pair of press rolls in a state wherein one face of the wet web is retained by said paper feeding belt.

* * * * *